US007458341B2

(12) United States Patent
Lannes

(10) Patent No.: US 7,458,341 B2
(45) Date of Patent: Dec. 2, 2008

(54) WATER HEATER WITH CONVOLUTED FLUE TUBE

(75) Inventor: Eric M. Lannes, Caledonia, MI (US)

(73) Assignee: Bradford White Corporation, Ambler, PA (US)

( * ) Notice: Subject to any disclaimer, the term of this patent is extended or adjusted under 35 U.S.C. 154(b) by 0 days.

(21) Appl. No.: 11/194,417

(22) Filed: Aug. 1, 2005

(65) Prior Publication Data

US 2007/0034170 A1 Feb. 15, 2007

(51) Int. Cl.
*F22B 7/18* (2006.01)

(52) U.S. Cl. ..... 122/155.5; 122/155.4

(58) Field of Classification Search ..... 122/155.5, 122/155.4, 155.3, 155.2, 155.1
See application file for complete search history.

(56) References Cited

U.S. PATENT DOCUMENTS

| | | | | | |
|---|---|---|---|---|---|
| 544,152 | A | * | 8/1895 | Benjumea | 122/155.4 |
| 1,170,834 | A | * | 2/1916 | Lovekin | 236/80 R |
| 1,296,194 | A | * | 3/1919 | Cour | 422/186.25 |
| 1,802,578 | A | * | 4/1931 | Schnepp | 122/19.1 |
| 2,379,155 | A | * | 6/1945 | Huff | 126/343.5 A |
| 2,874,683 | A | * | 2/1959 | La Rue | 122/18.3 |
| 3,079,992 | A | | 3/1963 | Otten et al. | |
| 3,138,201 | A | | 6/1964 | Huet | |
| 3,513,908 | A | | 5/1970 | Singh | |
| 3,802,499 | A | | 4/1974 | Garcea | |
| 4,157,706 | A | * | 6/1979 | Gaskill | 126/595 |
| 4,201,264 | A | | 5/1980 | Platt | |
| 4,266,513 | A | | 5/1981 | Schaus | |
| 4,442,799 | A | | 4/1984 | Craig et al. | |
| 4,632,066 | A | | 12/1986 | Kideys | |
| 4,653,434 | A | | 3/1987 | Wilhelm, Jr. | |
| 4,660,541 | A | | 4/1987 | Moore | |
| 4,677,939 | A | | 7/1987 | Henault et al. | |
| 4,889,105 | A | | 12/1989 | Vago et al. | |
| 4,926,798 | A | | 5/1990 | Kardos | |
| 4,929,798 | A | | 5/1990 | de Lasa | |
| 5,027,749 | A | | 7/1991 | Cifaldi | |
| 5,213,156 | A | | 5/1993 | Eriksson | |
| 5,253,703 | A | | 10/1993 | Master et al. | |
| 5,485,879 | A | | 1/1996 | Lannes | |
| 5,533,362 | A | | 7/1996 | Cook et al. | |
| 5,572,885 | A | | 11/1996 | Erickson | |
| 5,588,399 | A | | 12/1996 | Kim | |
| 5,596,952 | A | | 1/1997 | Lannes et al. | |
| 5,735,237 | A | | 4/1998 | Phillip et al. | |

(Continued)

*Primary Examiner*—Gregory A Wilson
(74) *Attorney, Agent, or Firm*—RatnerPrestia

(57) ABSTRACT

The present invention is directed towards a water heater having a combustion chamber and a water tank positioned adjacent to the combustion chamber. The water tank has a flue tube extending through or surrounded by the water tank and has an upstream end positioned to receive combustion gases from the combustion chamber and a downstream end positioned to exhaust the combustion gases. The flue tube also has a wall that extends between the upstream and downstream ends. The wall of the flue tube has an inner surface defining a combustion gas passage and an outer surface positioned to contact water received in said water tank. The walls have convolutions along at least a portion of their length and are configured to reduce laminar flow of the water adjacent the outer surface of flue tube, thereby providing increased heat transfer between the combustion gases in the flue tube and the water in the water tank.

12 Claims, 7 Drawing Sheets

U.S. PATENT DOCUMENTS 5,797,356 A * 8/1998 Khizh ..... 122/18.31
5,890,458 A 4/1999 Kim
RE37,240 E 6/2001 Moore, Jr. et al.
6,311,646 B1 11/2001 Selmani
6,422,179 B2 7/2002 Hughes et al.
6,564,755 B1 5/2003 Whelan

* cited by examiner

WATER HEATER WITH CONVOLUTED FLUE TUBE

FIELD OF THE INVENTION

This invention relates generally to a water heater and, in particular, to a water heater configured for increased heat transfer between combustion gases in the water heater's flue tube and water within the water heater's water storage tank.

BACKGROUND OF THE INVENTION

For industrial, commercial and domestic water heaters, combustible fuel is often used as a heat source. For example, natural gas has been a preferred choice of fuel.

A simple arrangement for a water heater is to place a burner below a to tank filled with water. The combusted hot gases are allowed to flow around the tank so that the water within will absorb heat from the combusted gases. As water heaters developed, an opening was placed through the center of the water storage tank so that combusted gases could pass both around the outside and through the center of the tank, giving more surface area for absorption of heat from the combusted gases. The pathway or hole through the center of the tank became known as the flue tube.

Eventually, water heaters were placed within enclosed areas; for example, a domestic water heater may be placed in the basement of the home. This created the need for the combusted gases to be exhausted under control, namely through exhaust ventilation systems. The need for ventilated exhaust systems encouraged the use of flue tubes and discouraged the passage of exhaust gases around the water storage tank.

Modern water heaters, therefore, have virtually eliminated passing combusted gases around the outside of the water tank. Instead, modern water heaters generally direct combusted exhaust through a central flue tube. Eliminating passing exhausted gases outside of the water storage tank reduced the surface area from which the water in the tank could potentially absorb heat from the combusted exhaust. Additionally, a flue tube placed within a water heater tank directly above the combusted gases allows the hot combusted gases to more quickly flow through the water tank without transferring heat.

There have been attempts to design a flue tube to allow for greater heat transfer from the combusted gases across the wall of the flue tube and into the water of the water storage tank. For example, U.S. Pat. No. 4,660,541 issued to Moore is directed to a water heater with a submerged combustion chamber. A baffle is positioned in the flue tube along its length and causes turbulence in the exhausted gases as they flow upward through the flue tube.

U.S. Pat. No. 4,677,939 issued to Henault et al. is directed to a heat exchanger for a fluid heating apparatus, particularly a domestic hot water accumulator. The flue tube in Henault et al. is a hermetically sealed tube disposed spirally in the lower third of an enclosure so that the different turns of the ringed tube are tangentially in contact with one another in order to form a compact exchanger.

Reissue Patent No. RE37,240 issued to Moore, Jr. et al. is directed to a water heater with reduced localized overheating. Moore, Jr. et al. teaches a small pump to circulate the water within the tank when the burner is activated so that any water separated into layers of different temperature will be mixed.

U.S. Pat. No. 4,157,706 issued to Gaskill is directed to a flue tube fitted with a turbulator means which disperses entering hot gases along the surface of the flue's inner wall. In the water tank, Gaskill provides another turbulator means which disperses water along the interior surface of the inner and outer water tank walls. The turbulator means is a continuous metal ledge situated in a spiral configuration along the tank's inner wall.

Despite the foregoing proposals, there remains a need for a simple flue tube design that helps to facilitate the transfer of heat from the combusted exhaust gases to the water in the water storage tank.

SUMMARY OF THE INVENTION

In one exemplary embodiment, this invention provides a water heater having a combustion chamber and a water tank positioned adjacent the combustion chamber configured to contain water to be heated. The water heater has a flue tube extending through or surrounded by the water tank. The flue tube has an upstream end positioned to receive combustion gases from the combustion chamber and a downstream end positioned to exhaust the combustion gases from the water heater. The flue tube has a wall extending between the upstream and downstream ends. The wall has an inner surface defining a combustion gas passage and an outer surface positioned to contact water received in the water tank.

Means are provided along the wall of the flue tube for reducing laminar flow of water adjacent the outer surface of the wall of said flue tube. The means to reduce laminar flow provides increased heat transfer between the combustion gases in the flue tube and water in the water tank. Such means optionally comprise convolutions that are configured to reduce laminar flow of water adjacent the outer surface of the wall of the flue tube to provide increased heat transfer between the combustion gases and water in the water tank.

In another exemplary embodiment, a method of producing a water heater having a combustion chamber, a flue tube and a water tank, is provided. The method includes the step of configuring the flue tube to reduce laminar flow of water in the water tank adjacent an outer surface of the flue tube. A further step of the method includes positioning the flue tube to extend through the water tank and to receive combustion gases from the combustion chamber.

BRIEF DESCRIPTION OF THE DRAWINGS

Exemplary embodiments of the invention will be described with reference to the figures of the drawings, of which.

DETAILED DESCRIPTION OF THE INVENTION

Although the invention is illustrated and described herein with reference to specific embodiments, the invention is not intended to be limited to the details shown. Rather,-various modifications may be made in the details within the scope and range of equivalents of the claims and without departing from the invention.

Figure 1:
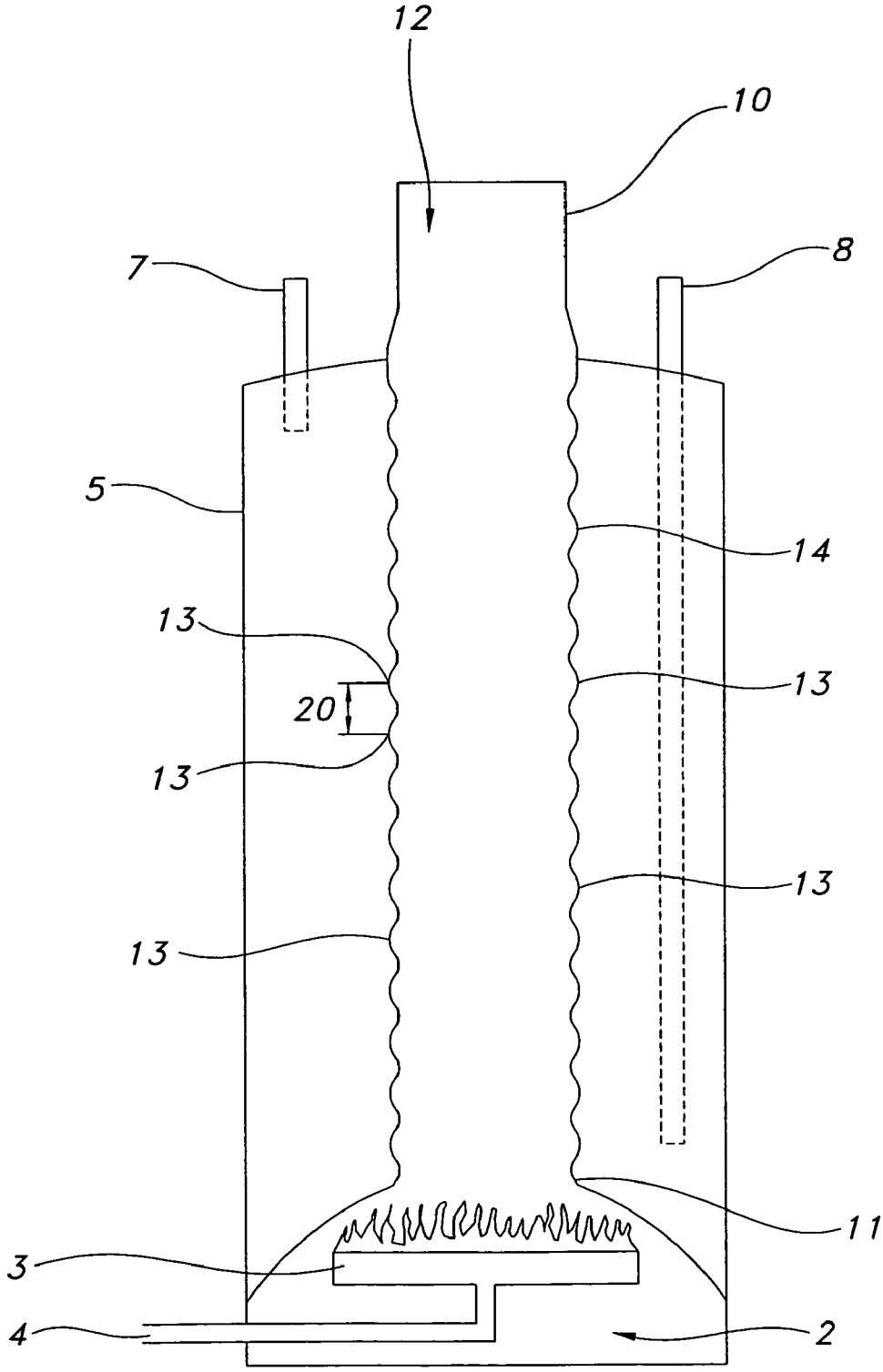
FIG. 1 is a front schematic view of an interior of an exemplary embodiment of a water heater having a flue tube according to aspects of this invention.

Referring to FIG. 1, a water heater 1 has a water tank 5 provided with a water inlet or dip tube 8 and a water outlet 7. Water tank 5 is positioned adjacent to a combustion chamber 2 (e.g., above combustion chamber 2 in the illustrated embodiment, though other configurations are contemplated). Combustion chamber 2 houses a burner 3, which combusts fuel such as gas or oil received from a fuel inlet 4.

The products of fuel combustion from burner 3 are carried upwardly through a flue tube 12, which extends substantially vertically through an interior of water tank 5 and is in a heat exchange relationship with the water contained in water tank 5. The flue tube 12 therefore extends through or is otherwise surrounded by the water tank 5. The flue tube has an upstream end portion 11 that accepts or receives combusted gases from combustion chamber 2 and a downstream end portion 10 positioned to expel exhaust gases from the water heater 1 into the atmosphere or into an exhaust conduit, for example.

The flue tube 12 has a flue tube wall 14 extending between the upstream and downstream ends of the flue tube 12. The flue tube wall 14 provides the barrier or interface between the combustion gases contained within the interior of the flue tube 12 and the water contained within the interior of the water tank 5. The transfer of heat from combustion gases to water occurs through the wall 14 of the flue tube 12.

Means are provided on the wall of the flue tube for reducing laminar flow of water adjacent the outer surface of the wall of the flue tube, thereby providing increased heat transfer between combustion gases in the flue tube and water in the water tank. According to an exemplary embodiment of the invention, the laminar flow reducing means comprises convolutions provided on the wall of the flue tube. For example, as shown in the embodiment of FIG. 1, convolutions 13 are provided along the length of flue tube wall 14.

Convolutions are optionally positioned along the length of the flue tube is from the upstream end to the downstream end of the flue tube. Also, the convolutions are optionally configured to promote turbulence in the water adjacent the outer surface of the wall of the flue tube. The convolutions can be evenly spaced along the wall of the flue tube or otherwise configured.

Figure 2:
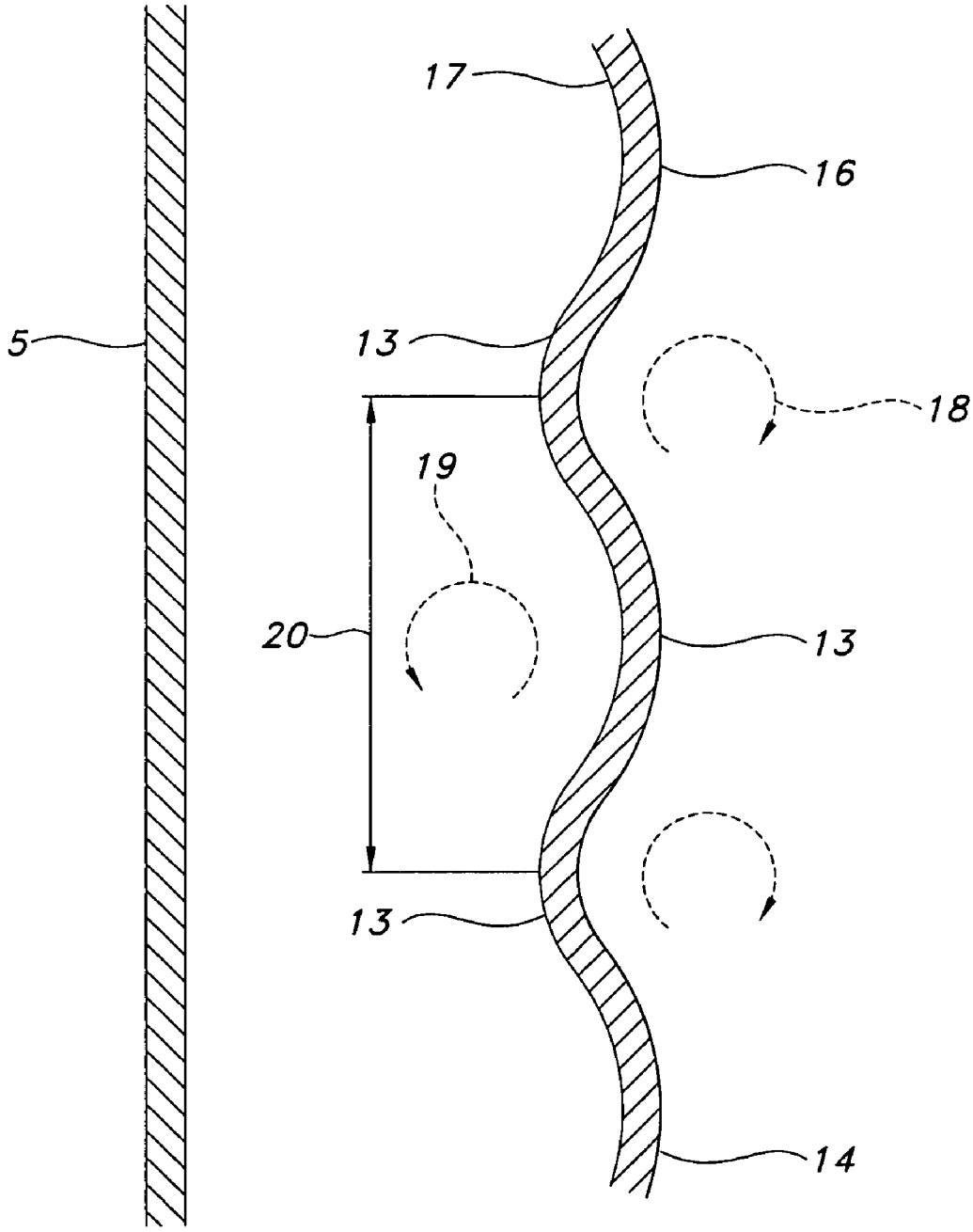
FIG. 2 is an enlarged cross-sectional view of a portion of the flue tube of the water heater shown in FIG. 1.

FIG. 2 is an enlarged cross-sectional view of a portion of the flue tube wall 14 illustrated in FIG. 1. Flue tube wall 14 has an inner surface 16 oriented toward the exhausted gases contained in flue tube 12 and an outer surface 17 oriented toward the water in water tank 5. Inner surface 16 of flue tube wall 14 has convolutions 13 that impart eddy currents 18 or turbulence in the exhaust gases flowing through flue tube 12. In other words, when hot combustion gases flow upwardly through the flue tube 12 when the burner 3 is active, the combustion gases adjacent the inner surface 16 of the flue tube 12 will have a reduction of laminar flow because of the convolutions 13. Such reduction of laminar flow (and promotion of turbulent flow) increases the transfer of heat from the combustion gases to the flue tube wall 14.

Likewise, outer surface 17 of flue tube wall 14 has convolutions 13 that impart water eddy currents 19 or turbulence in the water of water tank 5. In other words, when heated water in the water tank 5 adjacent the outer surface 17 of the flue tube 12 flows upwardly through the water tank 5 when the burner 3 is active, the water adjacent the outer surface 17 of the flue tube 12 will have a reduction of laminar flow because of the convolutions 13. Such reduction of laminar flow (and promotion of turbulent flow) increases the transfer of heat from the flue tube wall 14 to the water.

FIG. 2 also shows the distance between convolutions 13 as distance 20. Optionally, and for purposes of illustration, distance 20 may be about 1¼ inch; however, other distances greater or smaller are contemplated. The convolutions 13 in this exemplary embodiment are fluctuations in the diameter of the flue tube 12 between one or more smaller diameters and one or more larger diameters. The distance 20 shown in FIG. 2 is the distance between the portions of flue tube 12 having larger diameters.

Figure 3:
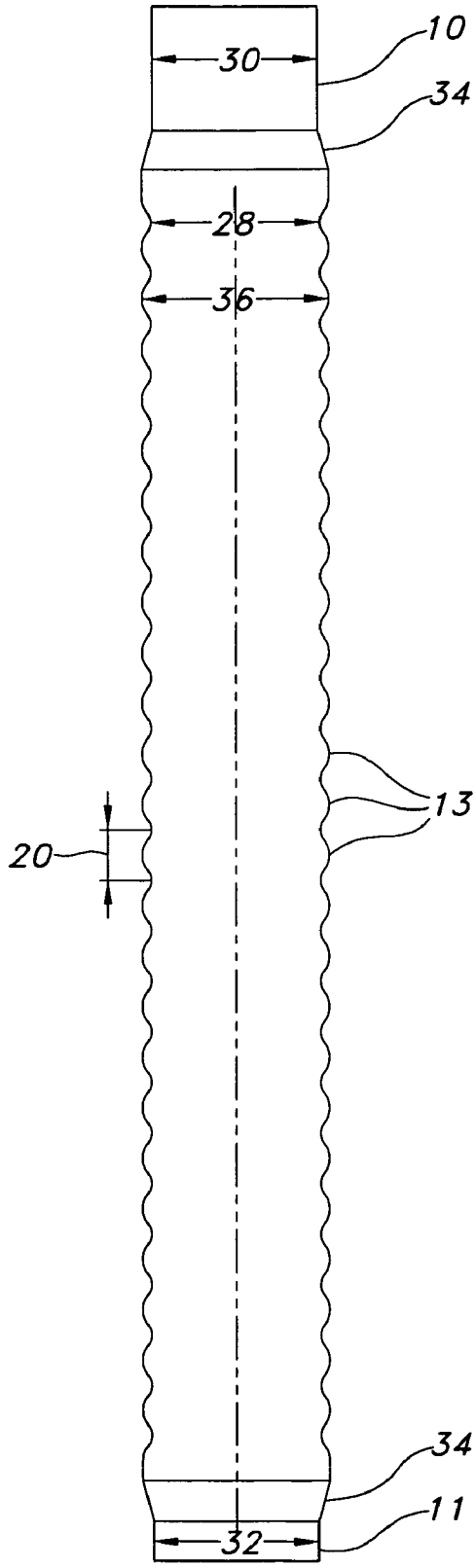
FIG. 3 is a front view of a flue tube according to one exemplary embodiment of the present invention.

FIG. 3 is a front view of flue tube 12 according to one exemplary embodiment of the present invention removed from water tank 5. FIG. 3 shows an elongated downstream end portion 10 of flue tube 12 and a shorter upstream end portion 11. The downstream end portion 10 is at the top of the flue tube 12 and the upstream end portion 11 is at the bottom of the flue tube 12 because combustion gases flow into the upstream end portion 11 and toward the downstream end portion 10. Because flue tube 12 is a cylinder, downstream end portion 10 has a diameter 30. Likewise, upstream end also has a diameter 32, which may be the same as or different from diameter 30. The end portions 10 and 11, which may have substantially constant cross-sectional shapes, provide surfaces for connecting the flue tube 12 to the water tank 5 or other components of the water heater 1. Optionally, downstream end portion 10 has a minimum length of about 3½ inch. Similarly, upstream end portion 11 has a minimum length of about 1 inch. Longer and shorter end portions 10 and 11 are contemplated as well. As shown in the exemplary embodiment of FIG. 3, downstream end portion 10 and upstream end portion 11 are adjacent to flared portions 34. Flared portions 34 are adjacent to convolutions 13.

Extending substantially along the length of flue tube 12 are a series of convolutions 13. As shown by flue tube 12 according to the exemplary embodiment described in FIG. 3, the distance 20 between convolutions 13, otherwise herein described as the periodicity or frequency of the convolutions, is substantially equal. In other words, the distance 20 between convolutions 13 is a series of regularly defined intervals.

Also shown in the embodiment of FIG. 3 is that convolutions 13 are of substantially even height or amplitude. In other words, the maximum and minimum diameters of the flue tube 14 that form the convolutions 13 are substantially the same for all convolutions 13. The convolutions 13 illustrated in FIG. 3 therefore alternate between portions having a substantially constant maximum diameter 36 and portions having a substantially constant minimum diameter 28.

Maximum diameter portions 36 of the convolutions of the flue tube 12 are optionally greater in diameter than the end portions 10 and 11 having respective diameters 30 and 32. As shown in FIG. 3, minimum diameter 28 is optionally about the same diameter as the diameters 30 and 32 of end portions 10 and 11, respectively. Because convolutions 13 terminate at the maximum diameter 36 proximal to end portions 10 and 11, flared portions 34 extend from the diameters of the end portions to maximum diameter 36 of convolutions 13. Accordingly, flue tube 12 can be formed by starting with a tube having a constant diameter corresponding to that of the end portions 10 and 11 and expanding portions of the flue tube 12 by mechanical means to form the convolutions 13.

Figure 4:
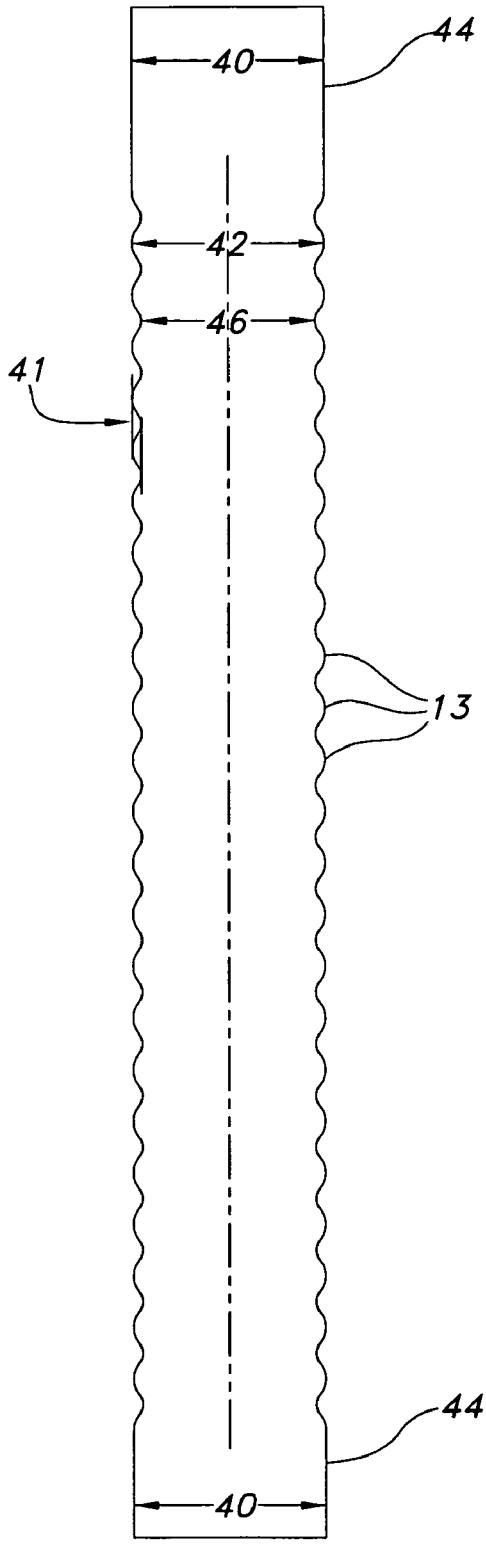
FIG. 4 is a front view of a flue tube according to another exemplary embodiment of the present invention.

Alternatively, in another exemplary embodiment of flue tube shown in FIG. 4, maximum diameter portions 42 of the convolutions of the flue tube are optionally about the same in diameter as the diameter 40 of end portions 44. Accordingly, flue tube 12 can be formed by starting with a tube having a constant diameter 40 corresponding to that of the end portions and indenting portions of the flue tube by mechanical means to form the minimum diameter portions 46 of convolutions 13.

The overall length of the flue tube (such as flue tube 12 shown in FIG. 3) can be adjusted depending upon the height of water storage tank 5.

According to the exemplary embodiment shown in FIG. 4, distance 41, (i.e., the distance between the radius at maximum diameter 42 and the radius at minimum diameter 46) is set such that laminar flow of exhaust gases along the inner surface of the flue tube and water currents along the outer surface of the flue tube are disrupted. Optionally, distance 41 is about ¼ inch. The portion of convolutions 13 forming maximum diameter portions 42 are optionally formed from an arc of a circle having a radius of about ½ inch, though a larger or smaller radius (or sharp angle) is also contemplated. Similarly, the shape of convolutions 13 forming minimum diameter portions 46 are optionally formed from an arc of a circle having a radius of about 11/32 inch, though a larger or smaller radius (or sharp angle) is also contemplated. In other words, the radius of curvature at maximum diameter portions of the flue tube may be the same or different from that at minimum diameter portions of the flue tube.

Figure 5A:
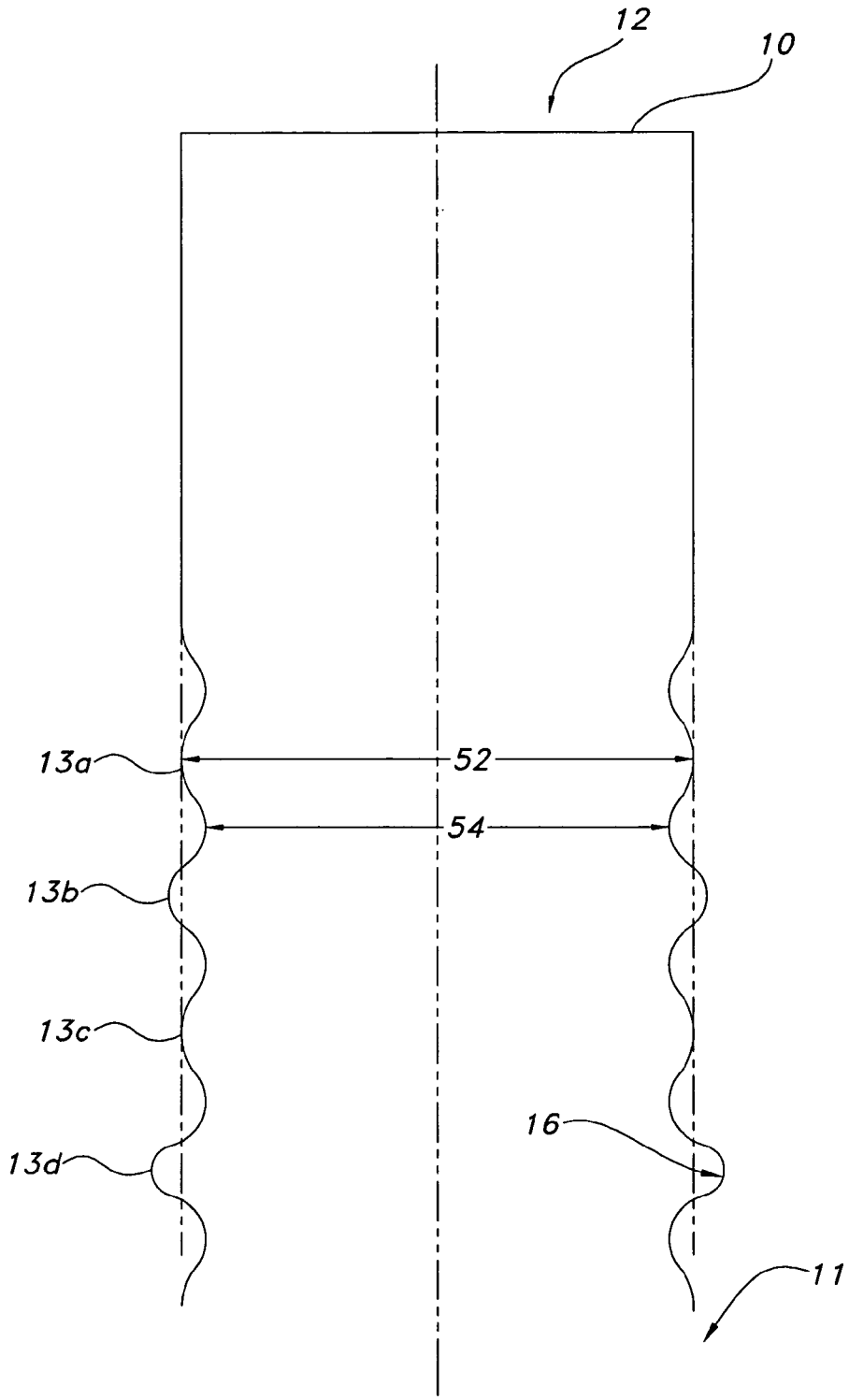
FIG. 5A is a cross-sectional front view of a water heater having a flue tube embodiment having convolutions of different sizes along the length of the flue tube according to an embodiment of the present invention.
Figure 5B:
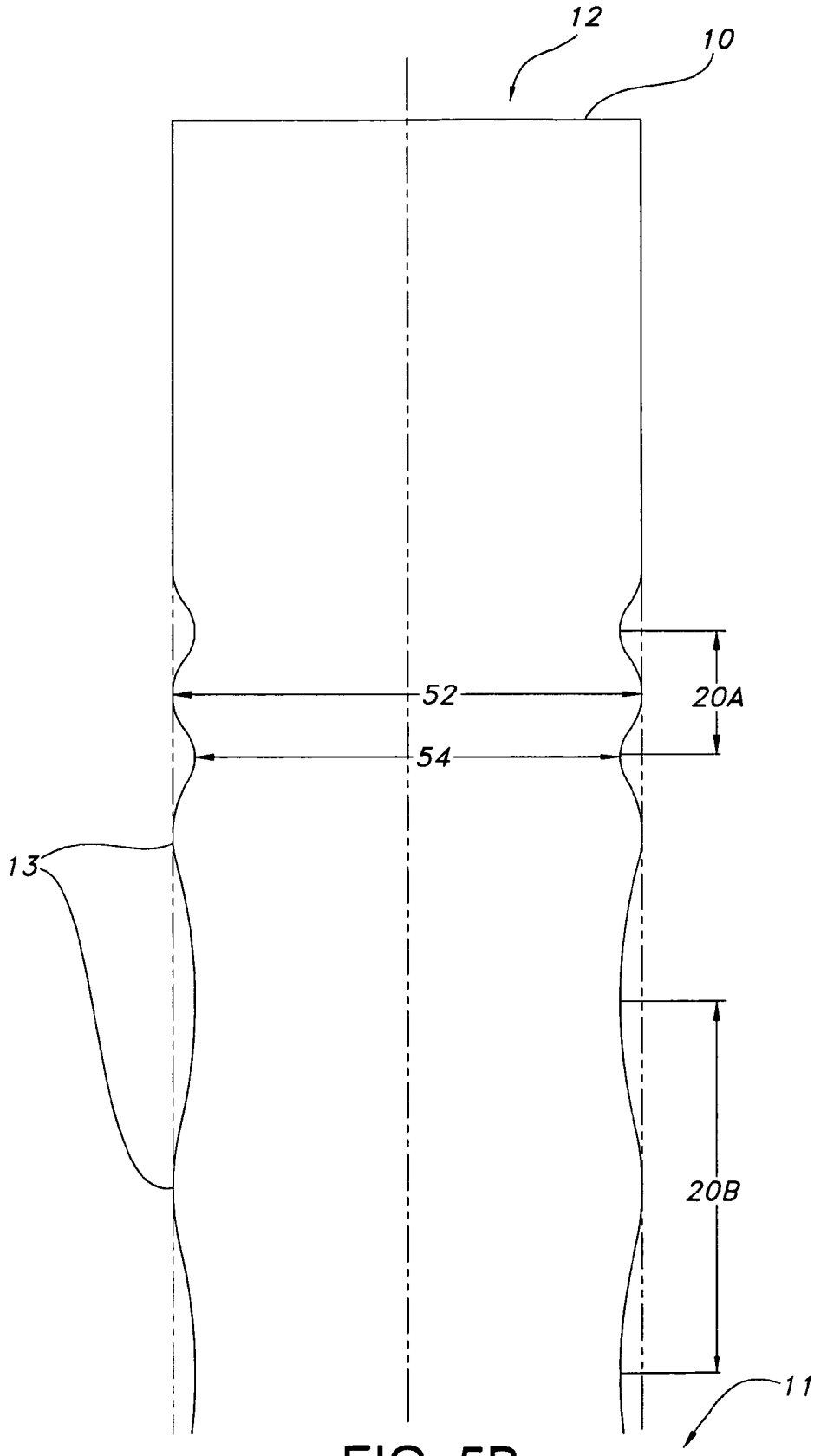
FIG. 5B is a cross-sectional front view of a water heater having a flue tube embodiment having different frequencies of convolutions along the length of the flue tube according to an embodiment of the present invention.
Figure 5C:
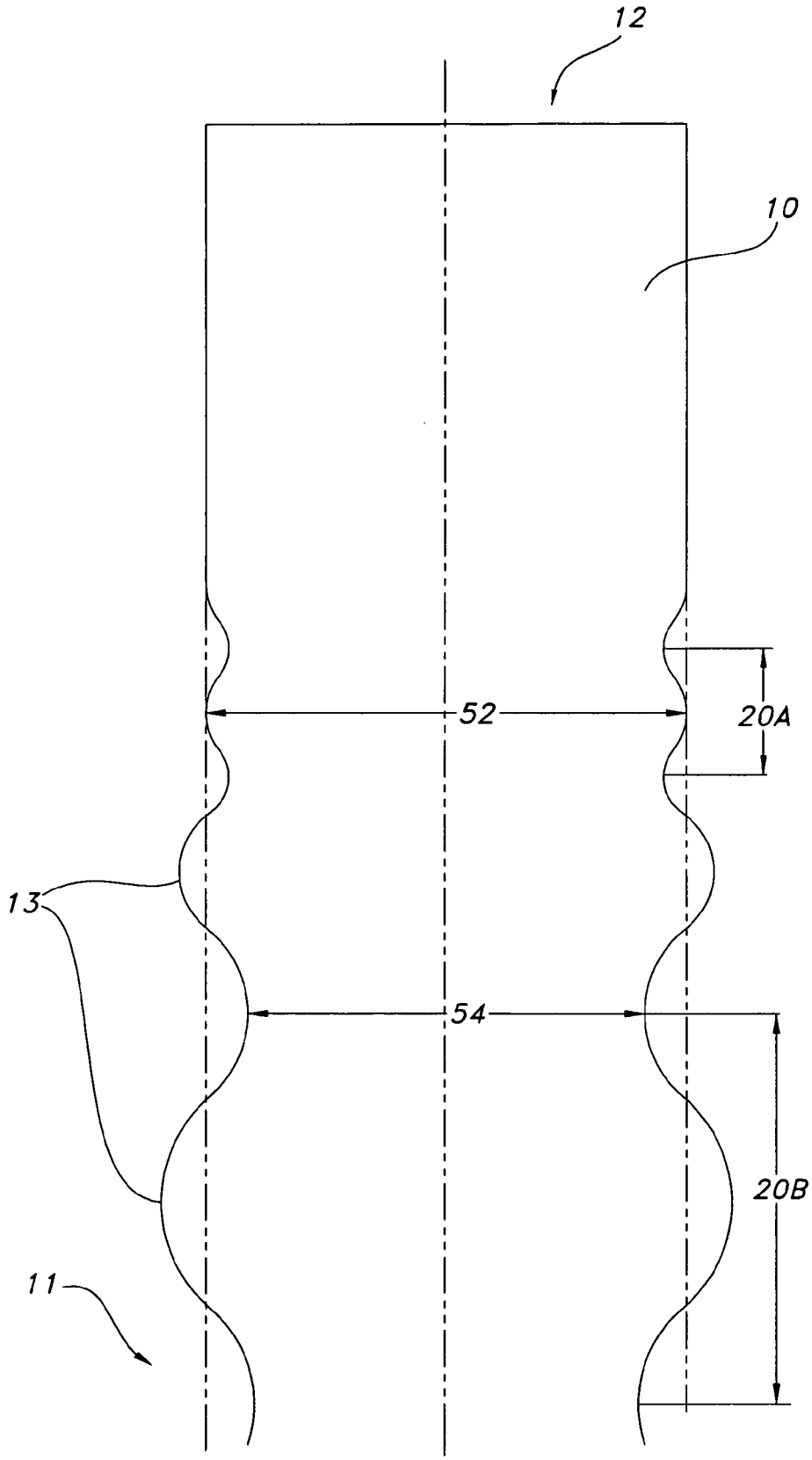
FIG. 5C is a cross-sectional front view of a water heater having a flue tube embodiment with convolutions on an upstream end being larger than the convolutions at a downstream end of the flue tube and a periodicity of convolutions that are greater at the downstream end than the periodicity at the upstream end.

FIGS. 5A, 5B, and 5C show various embodiments of the different configurations of convolutions 13 within the scope of the meaning of the term convolutions as used herein.

FIG. 5A shows convolutions 13 having varying height or amplitude, but having substantially the same periodicity or frequency 20, that is, the maximum diameter portions 52 and minimum diameter portions 54 are not consistent. For example, by varying the diameter of flue tube 12, convolutions 13 of differing height or amplitude are formed and may alternate or may increase in a graduated manner along the length of the flue tube 12.

FIG. 5B shows convolutions 13 having substantially the same height, that is, the maximum diameter portions 52 and minimum diameter portions 54 are substantially constant, but convolutions 13 vary in periodicity or frequency. In this manner, the distance between subsequent maximum diameter portions 52 vary as shown with reference numeral 20A and 20B. Referring now to FIG. 5B in more detail, the periodicity of convolutions 13 is optionally greater at downstream end portion 10 than the periodicity of convolutions 13 at upstream end portion 11. In other words, distance 20b between maximum diameter portions 52 is larger at upstream end portion 11 than distance 20a between maximum diameter portions 52 at downstream end portion 10.

The embodiment of convolutions 13 in FIG. 5C shows the periodicity of convolutions 13 and the height of convolutions 13 reversely proportionate along the length of the flue tube. Both the periodicity and amplitude of convolutions 13 may therefore change in a particular embodiment. In other words, the diameter of flue tube 12 is varied as well as the distance between successive convolutions. As shown in the exemplary embodiment, for example, the periodicity is greater at downstream end portion 10, and the height of convolutions 13 is greater at upstream end portion 11.

While not intending to be limited to describing the convolutions by characteristics that themselves are descriptive of the convolutions, namely height or amplitude and periodicity or frequency, these features may also be described with relation to varying diameters of the flue tube. For example, FIG. 5A may be described as having a flue tube 12 of varying diameters which account for the difference in height of the convolutions. Alternatively, the convolutions themselves may be described as forming a series of sinusoidal crests and troughs traveling parallel along the length of the flue tube wall. Finally, the convolutions may be described as a series of undulations transversely oriented in a repeating cycle and extending substantially along the length of the flue tube wall.

Referring now to the mechanism of the water heater of the present invention, it has been recognized that heat energy is transferred between two materials (such as a fluid and a solid) when there is a temperature difference between the two materials. Heat transfer to a fluid creates motion in the fluid. This motion is due to temperature changes in the fluid causing differences in fluid buoyancy of the fluid near the interface of the materials when compared to the fluid at a distance from that interface. This is known as "natural convection" and it is a strong function of the temperature difference between the materials.

Because the fluid closer to the interface is at a greater temperature than fluid at a distance from the interface, this temperature difference over a distance creates layers or boundaries in the fluid. The different layers flow at different rates. This flow can be either laminar, transitional or turbulent. Laminar flow generally occurs in relatively low velocities in a smooth laminar boundary layer over smooth surfaces. Turbulent flow forms when the boundary layer is shedding or breaking due to higher velocities or irregular surfaces. Transitional flow is the transition between laminar and turbulent flows.

Typically, when water in the water tank of a water heater is heated by the flue, there is a slow gradual upward flow of water along the flue tube's outer surface. This gradual upward flow creates a layer of water in laminar flow. This layer of water has an insulating effect against heat transfer. Laminar flow occurs in any fluid medium, therefore the insulating effect of laminar flow may also be found in the exhaust gases along the inside surface of the flue tube.

According to exemplary embodiments of the present invention, the laminar flow of water and/or of exhaust gases adjacent the wall of the flue tube is reduced and/or converted to turbulent flow in the form of eddy currents or other turbulent effects that sharply reduce the insulating effect of the laminar flow of the water and/or exhaust gases. By reducing the laminar flow, the water heater of the present invention promotes heat transfer from the combusted exhaust gases through the flue tube wall and into the water of the water tank.

In operation, when hot water is withdrawn from the water tank according to one embodiment of the present invention, the withdrawal triggers the burner into its "on" position. When the water heater is "on" gases are combusted creating an upward flow of hot combustion gases through the flue tube. The convolutions of the flue tube create eddy currents or other turbulence in the combustion gases and water along the inner and outer surfaces, respectively, of the flue tube wall in the manner described above and illustrated in FIG. 2. The eddy currents is illustrated as circular dashed lines 18.

According to one aspect of the present invention, increasing the draw of water increases the fuel consumption of the burner, which expels combustion gases through the flue tube at a greater velocity. Increasing the velocity of the exhaust gases along the inside surface of the flue tube imparts a greater turbulent flow or more violent eddy currents in the exhaust gases due to the convolutions along the inside length of the flue tube.

The combustion of the exhaust gases of the present invention occurs at or near the upstream end portion 11 of flue tube 12. As a result, the exhaust gases at the upstream end portion 11 are at a higher temperature than the exhaust gases at downstream end portion 10. Accordingly, the embodiments of the present invention shown in FIGS. 3-5 can be employed to address this temperature difference.

As shown in FIG. 5A, for example, convolutions 13*a-d* of different heights may be used to increase or decrease the velocity of flow of the exhaust gases along inner surface 16 of flue tube 12. FIG. 5B shows the periodicity of the convolutions 20A and 20B increasing from downstream end portion 10 to upstream end portion 11. As shown in FIG. 5C, convolutions 13 and periodicity 20A are optionally made smaller at upstream end 10 than convolutions 13 and periodicity 20B at downstream end 11 in response to the above-discussed temperature differences. Any number of variations in convolution height, periodicity, or size that disrupts laminar flow of both the exhaust gases and the water in the water storage tank is contemplated. A reduction of the size of convolutions 13 along the length of flue tube 12 can therefore be advantageous when used to transfer heat from gases that become progressively cooler as they travel through the flue tube.

As a result, turbulent combusted exhaust gases are more efficient at transferring heat through the flue tube wall and into the water in the water tank. As the heat is transferred through the flue tube wall and into the water of the water tank, the convolutions on the outer surface of the flue tube wall contacting the water in the water tank serve to break up laminar water flow and impart eddy diffusion currents or turbulent water flow. Again, by reducing the laminar flow of the water and reducing the insulating effect of the laminar flow, more heat may be transferred from the flue tube wall into the water in the water tank.

It is further expected that one or more convolutions formed along the wall of a flue provide increased recovery efficiency of the water heater by providing more surface area to extract heat from the combustion gases. Also, such an increase in surface area on the inside surface of the flue tube is expected to provide more surface to evaporate condensate from the flue gases.

Conventional devices such as thermostats, temperature and pressure valves and automatic switches are provided to regulate the safety and automatic operation of the water heater in accordance with the requirements of the user. Such devices are not detailed in the drawings or further described herein, as they are all well known to those skilled in the art.

Further particular details of the water heater itself have been shown in FIG. 1 only as examples. Details such as the nature of the fuel (gas, oil, wood, etc.), the type of burner (if applicable), or the position and shape of the water heater itself do not effect the scope or function of this invention.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

What is claimed is:

1. A method of producing a water heater having a combustion chamber, a substantially straight flue tube and a water tank, said method comprising the steps of:

indenting portions of the substantially straight flue tube of constant diameter by mechanical means to form convolutions along a longitudinal axis of the substantially straight flue tube that are at least partially defined by a series of crests along a length of the flue tube wall, each crest being defined on a plane orthogonal to a longitudinal axis of the flue tube, wherein the crests have a common outer diameter substantially equal to and no greater than a common outer diameter of end portions of the flue tube; and positioning the substantially straight flue tube to extend through the water tank and to receive combustion gases from the combustion chamber.

2. The method of claim 1, said indenting step comprising positioning convolutions along at least a portion of a length of the flue tube.

3. The method of claim 1, said indenting step comprising configuring the flue tube to promote turbulence in the water adjacent the outer surface of the wall of the flue tube.

4. The method of claim 1, said indenting step further comprising evenly spacing said convolutions along said wall of said flue tube.

5. The method of claim 1, said indenting step further comprising varying the frequency of said convolutions along said wall of said flue tube.

6. The method of claim 1, said indenting step further comprising forming said series of crests and troughs in a substantially sinusoidal shape along said wall of said flue tube.

7. The method of claim 1, said indenting step further comprising forming said series of crests and troughs such that a radius of curvature of said crests is not equal to a radius of curvature of said troughs.

8. The method of claim 7, said indenting step further comprising forming said series of crests and troughs such that said radius of curvature of said crests is greater than said radius of curvature of said troughs.

9. The method of claim 7, said indenting step further comprising forming said series of crests and troughs such that said radius of curvature of said troughs is greater than said radius of curvature of said crests.

10. The method of claim 1, said indenting step further comprising indenting a central portion of the substantially straight flue tube such that the end portions of the flue tube are of constant diameter.

11. The method of claim 1 further comprising the step of mounting one end of the substantially straight flue tube to an opening provided in the combustion chamber.

12. The method of claim 11 further comprising the step of mounting an opposing end of the substantially straight flue tube to an opening provided in the water tank.

* * * * *